United States Patent [19]

Belleli

[11] Patent Number: 4,630,673

[45] Date of Patent: Dec. 23, 1986

[54] CLAMPING ASSEMBLY HEAT EXCHANGER TUBE PLATES

[75] Inventor: Riccardo Belleli, Mantova, Italy

[73] Assignee: Belleli S.p.A., Mantova, Italy

[21] Appl. No.: 504,344

[22] Filed: Jun. 14, 1983

[30] Foreign Application Priority Data

| | | | |
|---|---|---|---|
| Jun. 21, 1982 | [IT] | Italy | 21968 A/82 |
| Oct. 15, 1982 | [IT] | Italy | 23204/82[U] |
| Oct. 22, 1982 | [IT] | Italy | 23890 A/82 |
| Mar. 15, 1983 | [IT] | Italy | 21112/83[U] |

[51] Int. Cl.[4] ..... F28F 9/06; F28D 1/06; F16L 39/00

[52] U.S. Cl. ..... 165/158; 165/72; 285/137.1

[58] Field of Search ..... 165/138, 158, 72, 173, 165/75, 76; 285/412, 137 R

[56] References Cited

U.S. PATENT DOCUMENTS

| | | | |
|---|---|---|---|
| 2,009,877 | 7/1935 | Dodd | 165/158 |
| 2,060,078 | 11/1936 | Hobbs | 165/72 |
| 2,213,410 | 9/1940 | Rathbun | 165/158 |
| 2,223,320 | 11/1940 | Jacocks | 165/158 |
| 2,290,528 | 7/1942 | Bertram | 165/158 |
| 2,296,710 | 9/1942 | Fischer | 165/158 |
| 2,340,756 | 2/1944 | Jacocks et al. | 165/158 |
| 3,721,291 | 3/1973 | Massaro, Jr. et al. | 165/158 |
| 4,325,428 | 4/1982 | Schuurman | 165/158 |

FOREIGN PATENT DOCUMENTS

| | | | |
|---|---|---|---|
| 615451 | 2/1961 | Canada | 165/158 |
| 520961 | 5/1939 | United Kingdom | 165/158 |

*Primary Examiner*—William R. Cline
*Assistant Examiner*—John K. Ford
*Attorney, Agent, or Firm*—Guido Modiano; Albert Josif

[57] ABSTRACT

The device comprises a segment ring effective to be inserted into a circumferential groove formed in the exchanger headpiece and having, in the radial direction such dimension as to include, within the annular portion projecting from the header chamber portion groove, small cylinders pressing against the peripheral area of the tube plate, a circumferential lug being further provided on the tube plate effective to be associated to the inside surface of the segment ring.

1 Claim, 8 Drawing Figures

6'
8
7
18
17
5
14a
14
20
19
15
1
3
2
16
4

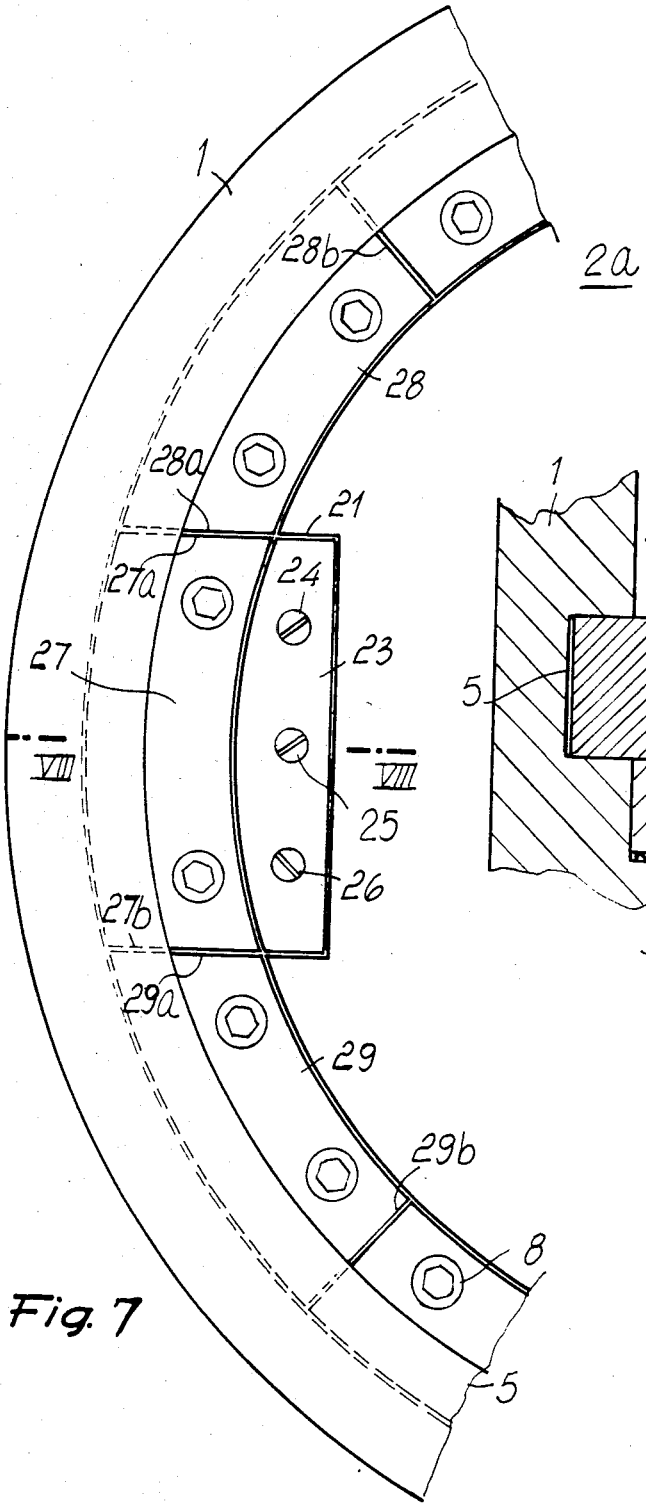
Fig. 7
Fig. 8
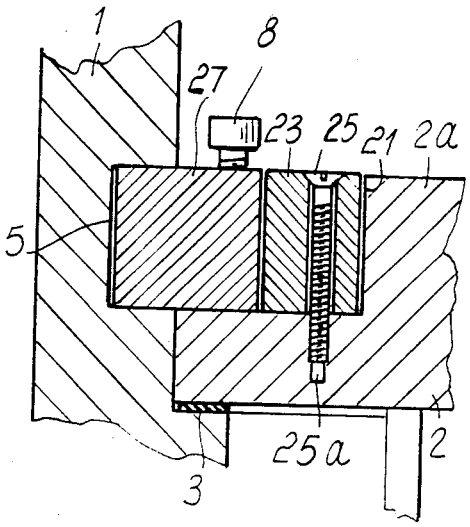

CLAMPING ASSEMBLY HEAT EXCHANGER TUBE PLATES

BACKGROUND OF THE INVENTION

This invention relates to an assembly for clamping tube plates in heat exchangers.

The technical field of heat exchangers is known to comprise a large variety of designs wherein a tube plate is arranged to bear, with the interposition of a gasket, on a surface suitably formed on the shell end, and is clamped in that position to sealingly separate the fluid flown through the tube interiors and the fluid which sweeps the tube exteriors in flowing through the space portion enclosed by the shell.

The devices for clamping the tube plate are quite numerous in the art, such as, to name but a few, a device which includes a plurality of stud bolts arranged around the gasket and adapted to be engaged with holes provided in the tube plate which is tightened down by means of nuts, or the one including a ring which is inserted into a peripheral grove of the tube plate, wherewith braces are associated which engage with a second ring overlying the peripheral area of said tube plate so as to compress it onto said gasket by tightening nuts provided at the brace ends.

The disadvantages of prior devices, among which the not negligible one of excessive space requirements in the radial direction as is evidenced by the cited examples, have induced the Applicant to provide a device which comprises a ring inserted into a circumferential groove formed in the thickness of the header portion at a position overlying the tube plate, and being provided, within the reach of the annular portion thereof projecting beyond said groove, with a means effective to press the underlying tube plate against the sealing gasket.

For its insertion into the circumferential grove, the ring is fabricated in plural segments which, of course, must be held in place, and this problem is solved, in the cited device, through the use of a unitary construction retaining ring which is inserted within the segmented ring on the opposite side to that facing the tube plate.

The device just described has shown to be of considerable value and advantageous; however, the actual experience made with the device and continued study directed to impart it with increasingly better characteristics have enabled the provision of the improvements which this patent aims to protect.

SUMMARY OF THE INVENTION

Thus, the task of this invention is to provide an improved device for clamping tube plates in heat exchangers, which affords the possibility of maximizing the diameter of the circumference containing the centers of the tube plate holes relating to the outermost tubes in the tube nest, thereby providing savings which, in view of the dimensions involved, may be of determining importance to the exchanger economy.

Within that task it is an object of the invention to provide a clamping device, whereby the segmented ring can be greatly stiffened, so as to enable it to be of moderate size.

It is a further object of the invention to provide a device which is specially compact, thus enabling a significant decrease of its axial overall dimension, and which can be very convenient to assemble, so as to bring about savings in its operation.

Yet another object of this invention is to provide a clamping device, wherein the divider diaphragm, as required with exchangers having a number of passageways at the tube side which is a multiple of two, such as those comprising U-like tubes, can be fabricated in a simpler manner.

According to one aspect of the invention the above task and objects are achieved by a clamping assembly for tube plates in heat exchangers, comprising a ring made up of a number of segments and effective to be inserted into a circumferential groove formed in the exchanger header chamber portion and having, in the radial direction, such dimensions as to include, in the reach of the annular portion thereof projecting beyond said groove, means effective to press against the peripheral area of the tube plate, bearing with the interposition of a sealing gasket, on a surface of said header portion, characterized in that it comprises within the header chamber a circumferential formation adapted to be associated, above said tube plate, with the inside diameter periphery of said segmented ring.

Advantageously, said circumferential member is formed by a lug formation on the tube plate, and may also be formed by a lug formation on a plate connected to one end of a circumferential sleeve which is in contact with said tube plate with its other end.

BRIEF DESCRIPTION OF THE DRAWINGS

Further features and advantages will be more readily apparent from the following description of some preferred, though not exclusive, embodiments of the invention, as illustrated by way of example and not of limitation in the accompanying drawings, where:

FIG. 7 is a fragmentary plan view of the embodiment according to FIGS. 5 and 6, after completion of formation of the segmented ring; and FIG. 8 is a sectional view taken along the line VIII—VIII of FIG. 7.

DESCRIPTION OF THE PREFERRED EMBODIMENTS

Throughout the cited figures, indicated at 1 is the header chamber portion of the exchanger, and at 2 the tube plate which is to be secured onto a seating surface 3' of said header portion with the interposition of a gasket 3 which provides a seal at the area enclosed by the shell 4 for the fluid contained therein.

Figure 1:
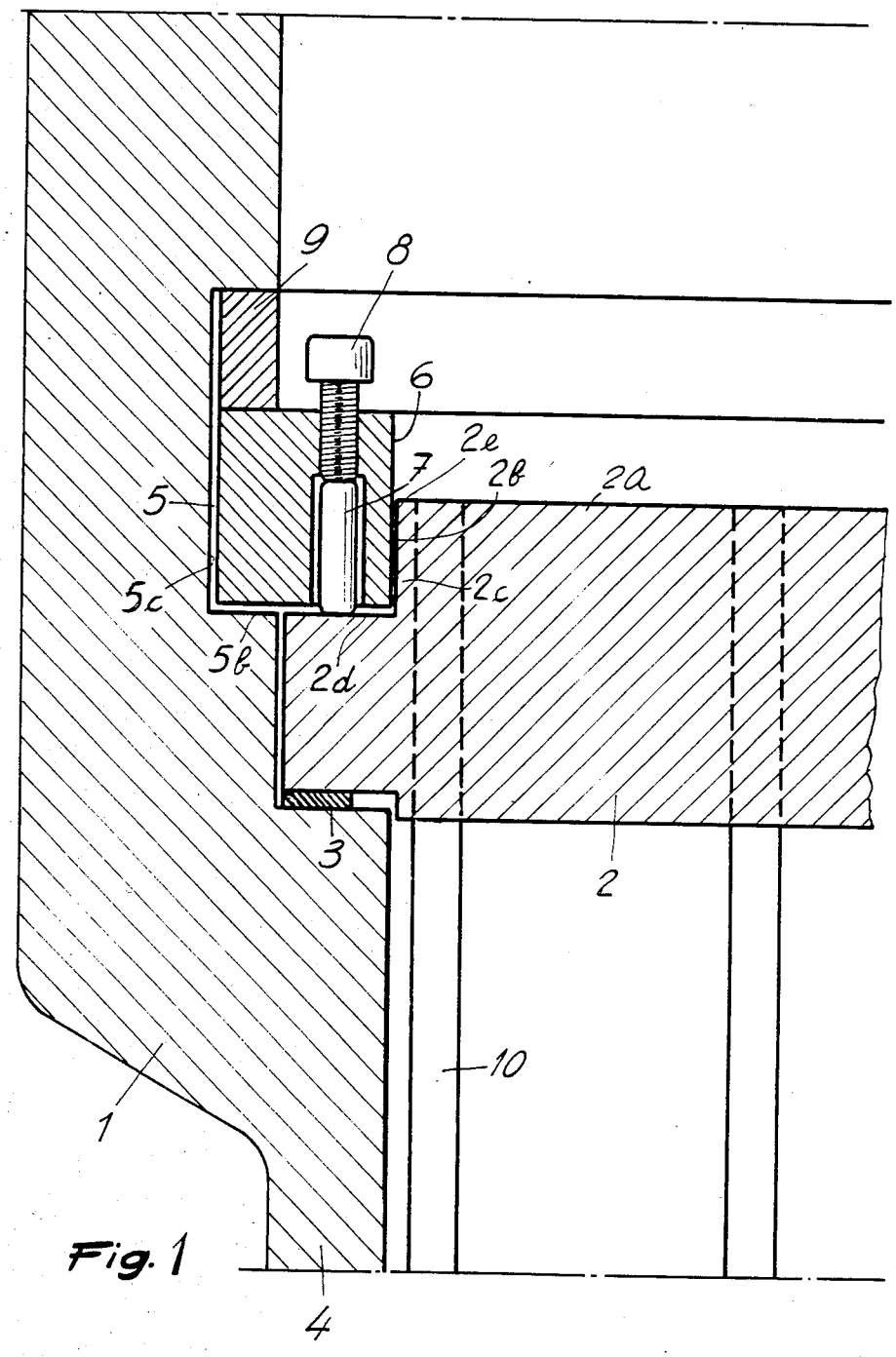
FIG. 1 is a fragmentary sectional view through a first embodiment of the invention, taken on a plane containing the longitudinal axis of the exchanger.

With reference to FIG. 1, a first embodiment of the clamping assembly structure of the invention will be now described; in this embodiment in the inner wall portion of the header portion 1 a circumferential groove 5 is formed, wherein there is inserted, in accordance with a prior technique developed by this Applicant, a ring 6, which is fabricated, for fitting it in place, from a number of segments. The ring 6 carries, at the annular portion projecting beyond the groove 5, means effective to press the plate 2 against the gasket 3, which means comprise, also according to developments by this same Applicant, a plurality of small cylinders 7 guided in equally spaced holes extending substantially parallel to the longitudinal axis of the exchanger, each of them being urged with one end against the tube plate 2 by the action of a screw 8.

The segments which make up the ring 6 are held in place by the circumferential member comprising the lug 2*a* on the tube plate 2, associated at the inside diameter of said ring 6, and finally, indicated at 9 is a second segmented ring, also inserted into the groove 5, which enables the segments of the ring 6 to be fitted and disassembled, and also transfers the force developed by the pressing means 7,8 cooperating with said ring 6 to the crown or ceiling or upper shoulder 5*a* of said groove 5, which has also a lower shoulder 5*b* and a cylindrical bottom surface 5*c*. As may be noted the lug 2*a* defines a step formation 2*b* having a riser surface 2*c* and a flange surface 2*d* extending transverse to the riser surface 2*c*. The riser surface 2*c* has a circumferential top edge 2*e*.

From the foregoing description of this first embodiment of the invention, it should be appreciated that the absence of any retaining rings within the segmented ring 6 enables the arrangement in the tube plate of tubes such as the one indicated at 10, which would be impossible to install where such a ring is provided, with a considerable saving in the economy of the construction.

Figure 2:
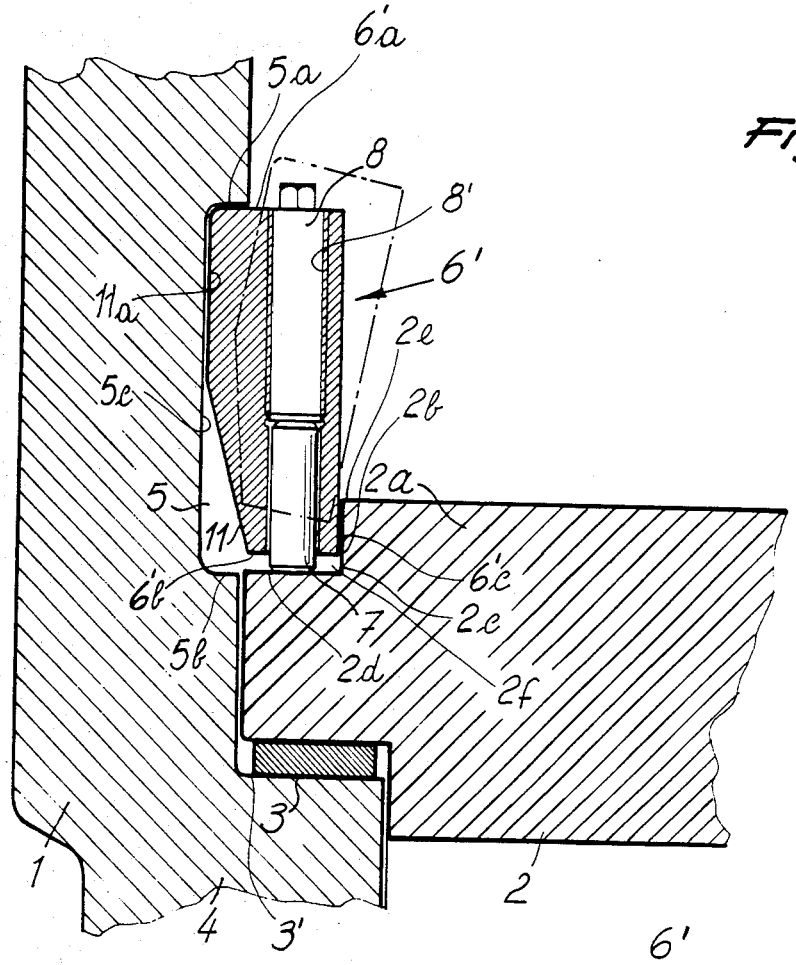
FIG. 2 is a similar sectional view through a first modified embodiment of the invention.
Figure 3:
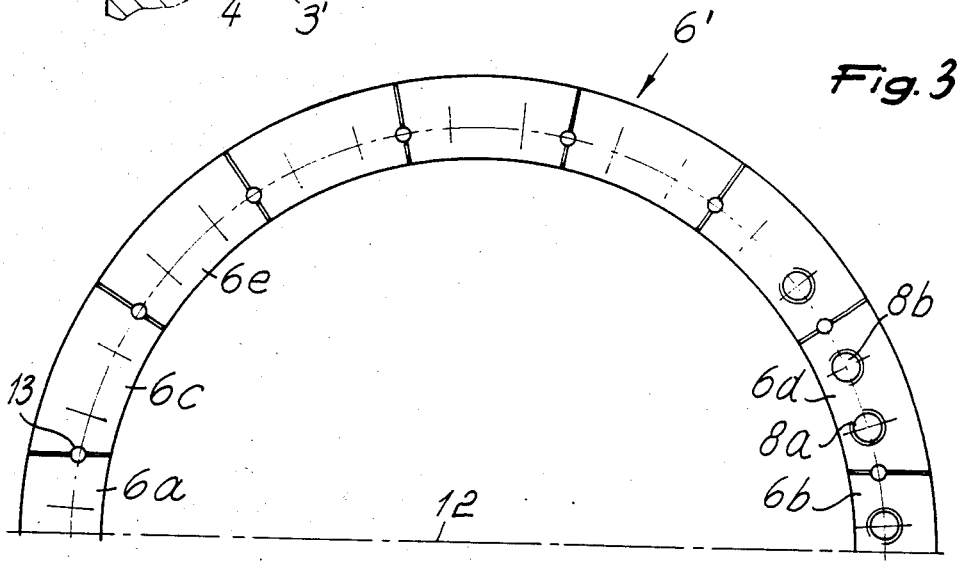
FIG. 3 is a plan view of one half of the segmented ring of FIG. 2.

FIGS. 2 and 3 illustrate a first modified embodiment of the invention; indicated at 6 therein is again the segmented ring which is inserted into the circumferential groove 5 and comprises a plurality of segments or elements, such as 6*a*,6*b*,6*c*,6*d*,6*e* etc. It will be noted from FIG. 2 that each segmented ring element 6′ comprises a top surface 6′*a* which mates with the upper shoulder 5*a* of the groove 5 and a base surface 6′*b* which clears the flange surface 2*d* of the step formation of the tube plate so that a gap 2*f* is formed therebetween. It will be further noted from the drawing that the segmented ring elements 6′ have further an external circumferential surface, a portion 11*a* whereof mates with the bottom surface 5*c* of the groove 5 and an internal circumferential surface, a portion 6*c* whereof is in mating engagement with the riser surface 2*c* of the step formation 2*b*, as explained below. The segments or elements 6′ include small plungers 7 urged by screws 8 inserted through threaded holes, of which only holes 8*a* and 8*b*, in the segment 6*d* are shown in FIG. 3.

The insertion in place of the individual segments, with their inside surface portion 6′*c* mating the riser surface 2*c* of the lug 2*a* on the tube plate, is allowed, with this embodiment, by the provision of a tapering region 11 on the external surfaces thereof tapering from the mating surface portion 11*a* towards the base surface 6′*b* of the element 6′. As visible in FIG. 2 the plungers 7 are slidably arranged in the lower portion of the hole 8. As clearly visible in FIG. 2, where the dash-and-dot outline shows an intermediate position of the insertion step. In other words each segment is assembled by merely slipping it in, utilizing the clearance afforded by the cutout resulting from the provision of said tapering surface.

For the purpose it is evident that the longitudinal extension of the segment ring elements 6′ i.e. the distance between the top surface 6′*a* and the base surface 6′*b* has to be smaller than the distance between the shoulders 5*a* and 5*b* of the groove 5. Moreover, as visible in FIG. 2 the diametrical extension of the segmented ring element, i.e. the distance between the external surface 11*a* and the internal surface 6′*c* thereof is equal to the sum of the diametral extension of the shoulder 5*b* of the groove 5 plus the diametral extension of the flange surface 2*d* of the step formation 2*b*.

The assembling sequence of the segments provides for the initial positioning of the segments in the arc extending between the segment 6*c* and segment 6*d*, these latter being excluded, and of the segments in the diametrically opposite arc, all segments being matingly limited by radial end surfaces; then, there are assembled the segments 6*c* and 6*d* and their symmetrical counterparts with respect to the diametrical plane 12, which are bordered by a radial surface and a surface parallel to said plane 12, and finally the segments 6*a* and 6*b* are inserted which have both their end surfaces parallel to the plane 12, without encountering interference problems.

Of course, the segments with their end surfaces parallel to the diametrical plane may differ in number from that above specified, the provision of just one of them being sufficient, although two would be preferred, as in the solution described, or four, arranged diametrically opposite.

If the segmented ring 6′ is formed, as is customary, from a forged single workpiece, the various segments being obtained by cutting separating surfaces, then it would be necessary, in order to achieve a correct positioning of the various segments, to insert therebetween play compensating pins, such as 13, to take up the play between the segments 6*a* and 6*c*.

The embodiment just described is highly compact, which ensures minimum axial space requirements, with favorable reflections on the size of the whole header portion of the exchanger.

Figure 4:
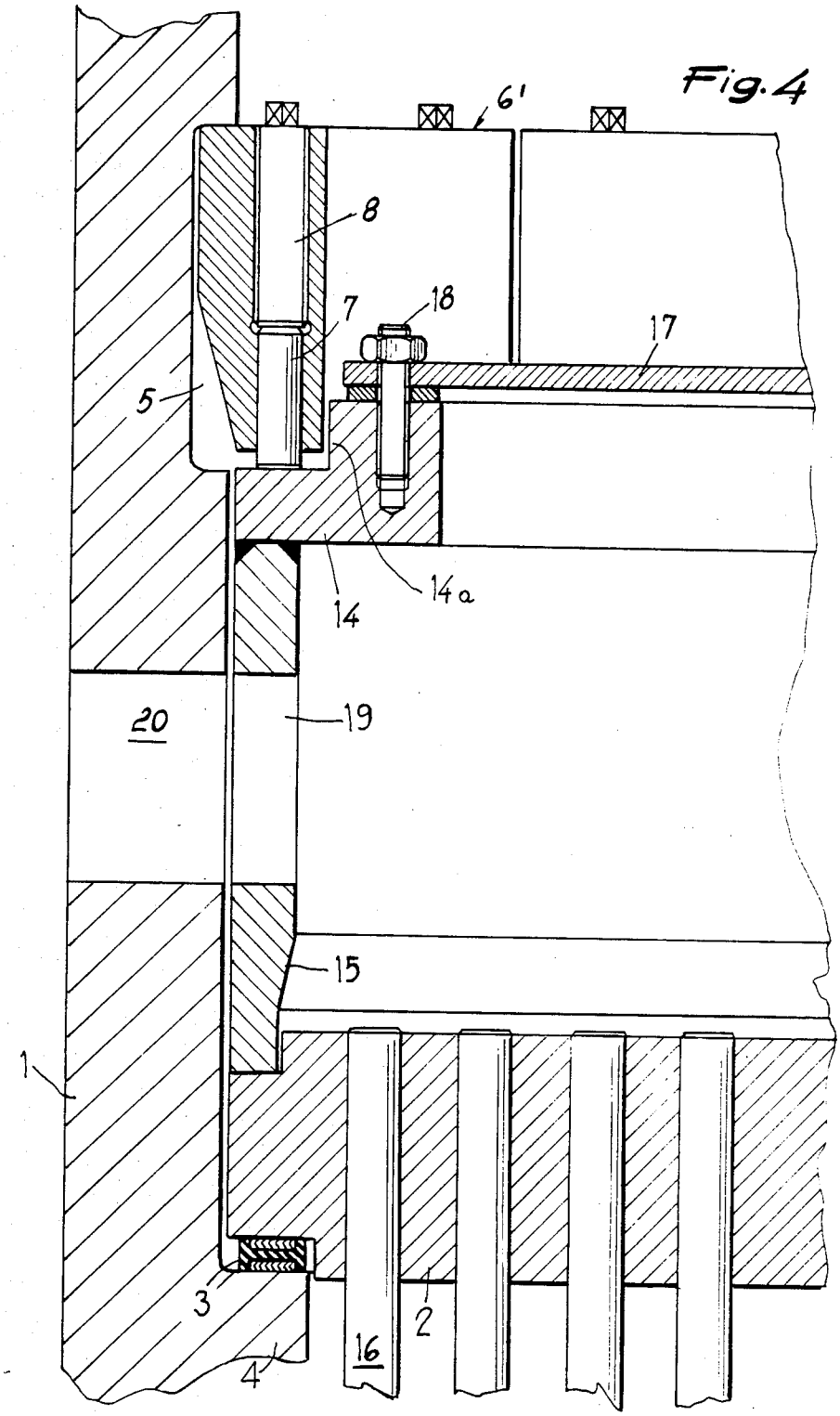
FIG. 4 is a fragmentary sectional view through a second modified embodiment of the invention, taken on a plane containing the longitudinal axis of an exchanger having two passageways at the tube side.

A second modified embodiment is shown in FIG. 4, and again indicated at 6′ is the ring inserted into the groove 5 and being formed by several segments including the small cylinders 7 urged by the screws 8.

In this case, the segments of the ring 6′, which are inserted thanks to the provision of the tapering portion described hereinabove, are held in place by a circumferential member which comprises the lug 14*a* of the plate 14 connected to the sleeve 15 which contacts with its other end the tube plate 2 at a minimum peripheral area, thus being allowed the obtainment of a very high value for the maximum drilling circumference diameter for the passage of tubes such as 16.

Formed in the sleeve 15 is the divider diaphragm, which is made necessary by this being an exchanger with two passageways at the tube side, simply with the provision of the cover 17, secured by stud bolts such as 18, and of a longitudinal partition or baffle, not shown in the figure, which extends from said cover to contact the tube plate 2; moreover, indicated at 19 is an opening in the wall of the sleeve 15 and aligned with the fluid passage hole 20, and a similar opening will, of course, be present at the other fluid passage hole formed in the header portion, with suitable seals, which are not shown in the drawing for simplicity.

Should the device be used with an exchanger having a single passageway at the tube side, the presence of the divider diaphragm is no longer necessary, thereby both the cover 17 and partition or baffle would be omitted.

It should be noted that in the embodiment just described, the segments of the ring 6' may lack the tapering region, and in that case, the slipping thereof in place would require a second segmented ring overlying the former, as shown in FIG. 1.

Figure 6:
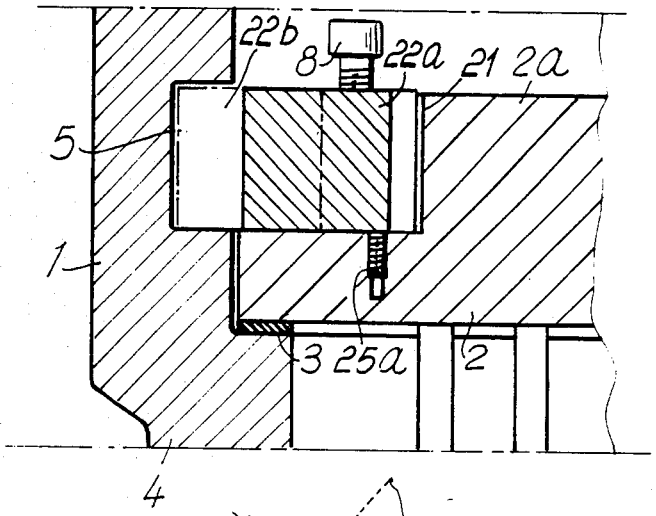
FIG. 6 is a sectional view taken along the line VI—VI of FIG. 5.
Figure 5:
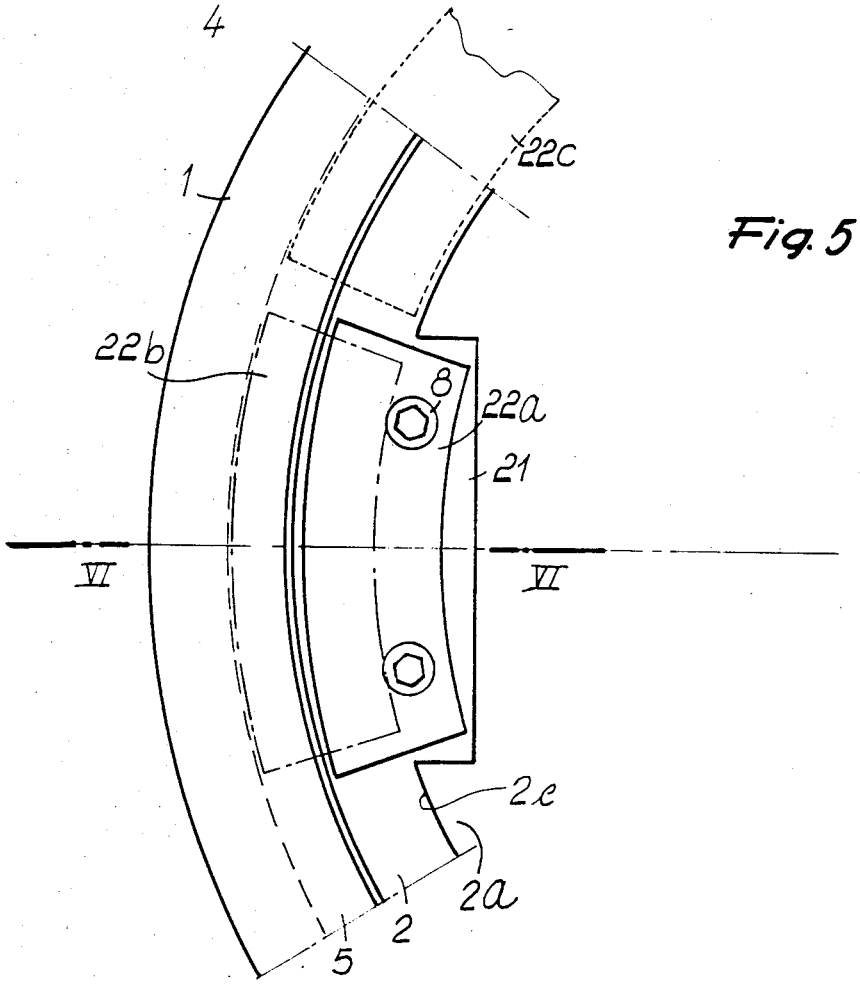
FIG. 5 is a fragmentary plan view of a third modified embodiment of the invention.

With reference to FIGS. 5,6,7,8, a third modified embodiment of the invention is illustrated, in which the segmented ring inserted into the circumferential groove 5, associated for holding in place the lug 2*a* of the tube plate 2 and provided with screws 8 which urge small plungers (not shown in said figures) against said tube plate 2, is positioned in accordance with the procedure which will be presently explained with reference to FIGS. 5 and 6.

In said figures, indicated at 21 is a peripheral cutout or centripetally recessed portion in the lug 2*a* or riser surface 2*c* of the tube plate, and shown in full lines is the position taken by one ring segment 22*a* inside said cutout 21 by mere insertion with a movement in a substantially perpendicular direction to the plane of the tube plate 2.

At the position 22*a*, the segment will face the circumferential groove 5, and may thus be pushed into it with a movement in a substantially radial direction until it occupies the position 22*b* shown in dash-and-dot lines, to be finally pushed, as indicated by the position 22*c* shown in dash lines, along said circumferential groove 5 to occupy its final assembly position within the ring.

The segments are progressively inserted one after the other in accordance to the procedure described, and in FIGS. 7 and 8 the final situation is depicted, with the fully assembled ring inserted into the groove 5 and associated with the lug 2*a* of the tube plate, and with the cutout 21 shut by the plug 23 fitting therein and secured to the plate 2 by means of the screws 24,25 and 26 inserted through throughgoing holes and engaging with threaded holes such as 25*a* formed in the tube plate.

In FIG. 7, it may be seen that the last segment to be inserted for completing the ring is the one indicated at 27 which has, purposely to enable its insertion, the end surfaces 27*a* and 27*b* substantially parallel to its diametrical symmetry plane, and the segments 28 and 29 contiguous to the segment 27 also have their end surfaces 28*a* and 29*a* of the same pattern, whereas the other end surfaces 28*b* and 29*b* follow a radial pattern similarly to those of all the other segments in the ring.

It is important to observe that in the invention, which achieves the greatest possible reduction in axial space requirements, the cutout or recess 21 in the lug of the tube plate is formed at an area, as normally provided in heat exchangers, which is unoccupied by the tubes of the tube nest because it is located at the protective screen for said tubes at the inlet of the fluid at the shell side.

A highly favorable feature of all the embodiments described hereinabove is the considerable stiffening effect applied to the segmented ring by the provision of the circumferential member comprising the lug 2*a* of the tube plate or 14*a* of the plate 14, and this enables said ring to be dimensioned with a limited thickness, and accordingly, greater compactness of the device.

All of the embodiments described further make the assembling of the segmented ring quite easy, with good reflections on the shortening of the processing time.

The invention as described is susceptible to many modifications and variations, in addition to those described, without departing from the scope of the instant inventive concept: thus, as an example, the screws 8 may react, rather than against as many small cylinders as are the screws themselves, against a single ring, possibly fabricated in plural segments, in contact with the tube plate.

In practicing the invention, all of the parts may be replaced with other, technically equivalent, elements; furthermore, the materials used, and the shapes and dimensions, may be any selected ones to meet individual requirements.

What is claimed is:

1. In an annular heat exchanger having a a longitudinal and a radial extent including a header chamber portion extending from a shell portion of the heat exchanger and having an annular seating surface means and a tube plate having a shell side facing the shell portion and a head side facing the header chamber portion of the heat exchanger and resting with said shell side thereof onto said seating surface means, a clamping assembly structure comprising a circumferential groove in said header chamber portion, at a distance from said seating surface means and coaxial therewith, said groove defining a first upper shoulder means near said head side of the tube plate and a second opposite shoulder means longitudinally at a distance from said head side of the tube plate and an outwardly recessed circumferential longitudinally extending cylindrical bottom surface of said groove and connecting said first and said second shoulders, in said tube plate at said head side thereof a circumferential step formation facing said groove, said step formation having a flange surface and a longitudinally extending riser surface transverse thereto and having a circumferential top edge, said flange surface and said riser surface being inwardly offset with respect to said first and second shoulder means, a segmented ring comprising annular segment elements with a top surface and a base surface, each said element having a longitudinal extension which is less than the distance between said first and said second shoulder means and greater than the longitudinal distance between said second shoulder means and said top edge of said riser surface thereby to leave a gap between said base surface and said flange surface and having a diametral extension which is substantially equal to the sum of the diametral extensions of said second shoulder and said flange surface, said segmented ring elements having each an external longitudinally extending first mating surface portion in mating engagement with at least part of said bottom surface of said groove, said segmented ring elements having each a longitudinally extending internal second mating surface portion in mating engagement with at least part of said riser surface and inwardly offset with respect to said external first mating surface, said segmented ring elements having each a radially extending third mating surface portion extending transverse to said first and said second mating surface portions and in mating engagement with said second shoulder means and, wherein said segmented ring elements have each a tapering region at the outward surface thereof, tapering from said first mating surface portion towards said base surface thereof thereby to allow insertion by a tilting movement of said segmented ring elements into the space between said step formation and said circumferential groove, pressing means within said segmented ring elements, said pressing means having one end portion thereof projecting towards said flange surface of said step formation beyond said segmented ring element thereof and in pressing engagement with said flange surface, thereby to clamp said tube plate against said seating surface means.

* * * * *